US005674352A

United States Patent [19]

Yu et al.

[11] Patent Number: 5,674,352

[45] Date of Patent: Oct. 7, 1997

[54] PROCESS RELATED TO A MODIFIED POLISHING PAD FOR POLISHING

[75] Inventors: Chris Chang Yu; Tat-Kwan Yu, both of Austin, Tex.

[73] Assignee: Motorola, Inc., Schaumburg, Ill.

[21] Appl. No.: 456,278

[22] Filed: May 15, 1995

Related U.S. Application Data

[63] Continuation of Ser. No. 77,265, Jun. 17, 1993.

[51] Int. Cl.[6] ..... H01L 21/306

[52] U.S. Cl. ..... 156/636.1; 156/645.1; 156/345 LP; 716/88

[58] Field of Search ..... 156/636.1, 645.1, 156/345; 216/88, 89; 51/281 R, 283 R, 328, 281 SF, 131.3, 131.4

[56] References Cited

U.S. PATENT DOCUMENTS

| | | | |
|---|---|---|---|
| 4,842,678 | 6/1989 | Noro et al. | 716/88 |
| 5,096,854 | 3/1992 | Saito et al. | 216/89 |
| 5,534,106 | 7/1996 | Cote et al. | 156/636.1 |
| 5,611,943 | 3/1997 | Cadien et al. | 156/636.1 |

*Primary Examiner*—R. Bruce Breneman
*Assistant Examiner*—Anita Alanko
*Attorney, Agent, or Firm*—George R. Meyer

[57] ABSTRACT

The present invention includes a modified polishing pad and methods on how to form and use the polishing pad. In one embodiment, a modified polishing pad is formed similar to polishing substrates except that the modifying pressure should be large enough to mechanically deform part of the polishing pad. The modifying pressure is typically at least 10 pounds per square inch. The materials used to modify the pad should be hard with a smooth surface. Examples of these materials are metals, dielectrics, and semiconductors. After modifying the polishing pad, it may be used to polish semiconductor substrates. Compared to a fresh pad, the modified polishing pad should have a higher planarization efficiency and be less likely to cause corner rounding of a patterned layer adjacent to an opening.

18 Claims, 4 Drawing Sheets

-PRIOR ART-

-PRIOR ART-

-PRIOR ART-

PROCESS RELATED TO A MODIFIED POLISHING PAD FOR POLISHING

This is a continuation of patent application Ser. No. 08/077,265, filed Jun. 17, 1993.

FIELD OF THE INVENTION

The present invention relates to the field of semiconductor devices, and in particular, to polishing pads used in chemical-mechanical polishing semiconductor substrates.

BACKGROUND OF THE INVENTION

Planarization of semiconductor substrates is becoming more important as the number of layers used to form a semiconductor device increases. Nonplanar semiconductor substrates have many problems including difficulty in patterning a photoresist layer, formation of a void within a film during the film deposition, and incomplete removal of a layer during an etch process leaving residual portions of the layer, which are sometimes called "stringers." A number of planarization processes has been developed and include chemical-mechanical polishing.

FIGS. 1 and 2 include illustrations of a part of one type of a chemical-mechanical polisher that is used to polish semiconductor substrates. FIG. 1 is a cross-sectional view of a chemical-mechanical polisher 10. The polisher 10 has a platen 11 and a polishing pad 12 attached to the platen 11 with an adhesive compound (not shown). Above the polishing pad 12 are substrate holders 13, and each substrate holder 13 has a semiconductor substrate 14. The polisher 10 also includes a polishing slurry and a slurry feed, both of which are not shown. The polishing pad 12 may be made of a porous polyurethane material. FIG. 2 illustrates the relative motion of the semiconductor substrates 14 and the polishing pad 12. Typically, the polishing pad 12 and semiconductor substrates 14 rotate in the same direction. FIG. 2 illustrates both rotating in a counterclockwise direction, although they could both be rotated in a clockwise direction. While the rotations occur, the substrates 14 oscillate laterally back and forth over a portion of the polishing pad 12. The polishing pressure, which is the amount of pressure between the substrates 14 and the polishing pad 12 during polishing, is typically no greater than about 8 pounds per square inch (about 55 kilopascals). At higher polishing pressures, the substrates 14 may be fractured during polishing causing the substrates 14 to be scrapped.

The polishing pad 12 has a plurality of asperities lying at the surface of the polishing pad. An asperity is a peak that protrudes from the polishing pad, and each asperity has an asperity radius and an asperity height. The asperity radius is the approximate radius of curvature at the end of an asperity, and the asperity height is the distance that the asperity height extends from the polishing pad. Those skilled in the art appreciate that the asperities vary in radius, height, and even shape. The plurality of asperities generally define the polishing surface of the polishing pad. Topology changes along the surface of the polishing pad determine the surface roughness of the polishing pad. The polishing pad is characterized by an average asperity radius, a standard deviation of asperity heights, and a root mean square surface roughness. A conventional polishing pad that has not been pretreated is hereinafter referred to as a "fresh pad." A typical fresh pad has an average asperity radius of about 35 microns, a standard deviation of asperity heights of about 35 microns, and a root mean square roughness of about 35 microns.

FIG. 3 includes an illustration of a portion of the semiconductor substrate 14 and a portion of the polishing pad 12.

The substrate 14 has a region 34 with a patterned layer 33 with an opening 39 that exposes a portion of region 34. Region 34 may be a semiconductor material or a layer of material adjacent to a semiconductor material that is not shown. The polishing pad 12 has an asperity 35 that has a shape that is generally parabolic. The asperity 35 has an asperity radius 36. Patterned layer 33 is normally to be polished without significantly polishing region 34 or substantially changing the shape of opening 39. Asperity 35 extends to exposed surface of region 34 when the asperity 35 is in-line with the opening 39. Planarization efficiency is being defined as the polishing rate of a layer or region to be planarized divided by the polishing rate of another layer or region that is not to be planarized. Referring to FIG. 3, the planarization efficiency would be the polishing rate of the patterned layer 33 divided by the polishing rate of the exposed portion of region 34. The contact of the asperity 35 with region 34 causes region 34 to be mechanically polished which is undesired. The planarization efficiency is reduced because the asperity 35 contacts the exposed portion of region 34. Also, the corners of the patterned layer 33 are rounded by the asperity 35 as the asperity 35 goes in and out of the opening 39. The distance between openings may need to be increased to account for corner rounding. This generally results in wasted substrate area and is undesired.

The fresh pad is also expected to cause dishing. Dishing is nothing more than local overpolishing. Assume that substrate 14 has a second layer that lies at the patterned layer 33 and within the opening 39. That portion of the second layer (not shown) that lies at the patterned layer 33 is to be removed while the portion of the second layer within the opening 39 is to remain. Part of the second layer that lies within the opening 39 is typically removed during polishing because asperity 35 may dig out a portion of the second layer. The surface of the second layer within the opening 39 after polishing looks like a dish, hence term "dishing." A fresh pad has significant problems with dishing because of asperities that are similar to asperity 35.

A plurality of pretreating processes may be used to pretreat a fresh pad prior to using it to polish semiconductor substrates. In one method, an abrading tool, which has a rough surface with relatively sharp protruding features, may be used to pretreat the polishing pad. The rough surface with the features may snag on some of the polishing pad material and actually decrease the average asperity radius, increase the standard deviation of asperity heights, and increase the root mean square surface roughness. In another pretreating method, the fresh pad is placed in a press and heated. The pressing is typically performed to densify the pad, but densifying the pad inhibits slurry transport throughout the polishing pad and is generally undesired.

SUMMARY OF THE INVENTION

The present invention includes a polishing pad that has a higher average asperity radius, a lower standard deviation of asperities heights, and a smaller root mean square surface roughness compared to a conventional polishing pad. The present invention also includes methods of polishing semiconductor substrates with the modified polishing pad. The modified polishing pad should have a higher planarization efficiency and is less likely to cause corner rounding or dishing.

Other features and advantages of the present invention will be apparent from the accompanying drawings and from the detailed description that follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF EMBODIMENTS

The present invention includes a polishing pad that helps to increase the planarization efficiency, reduce corner rounding of a patterned layer adjacent to an opening, or reduce dishing. The polishing pad may be used on a polisher that can polish one or more semiconductor substrates at a time. Many commercial polishers are capable of polishing one, two, five, or six wafers during the same polishing operation. Obviously, the present invention is not limited to any one of these polishers. Beyond improvements to a semiconductor process, one benefit of the present invention is the ease in which a polishing pad may be modified as is discussed in more detail below.

Figure 4:
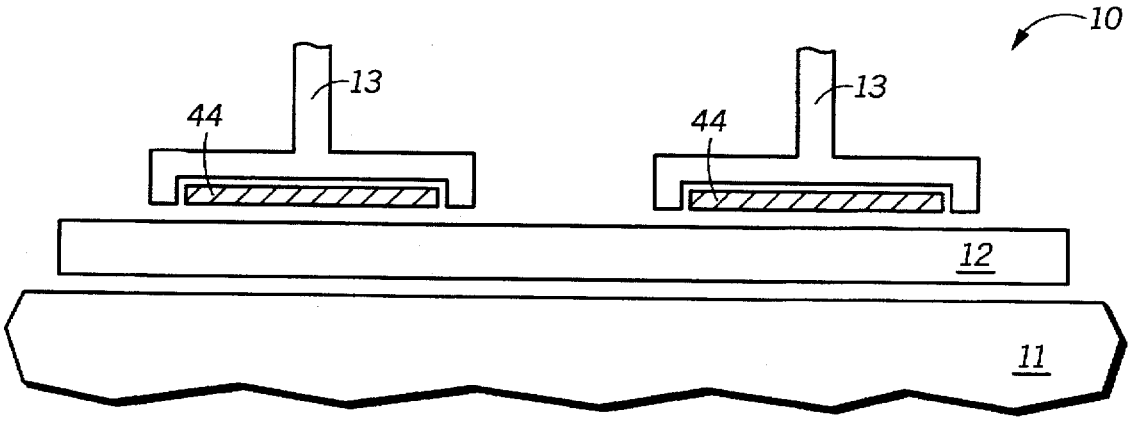
FIGS. 4 and 5 include cross-sectional and top views of a polishing pad and objects to modify the polishing pad in accordance with the present invention.

FIG. 4 includes an illustration of the polisher 10, platen 11, polishing pad 12, and substrate holders 13. Objects 44 are mounted within the substrate holders 13. Each object 44 has a shape that is similar to substrate 14. Object 44 is any material that is relatively hard, yet has a smooth surface when in contact with the polishing pad 12. As used in this specification, smooth surface means that the surface has a root means square surface roughness less than about 30 microns. For example, object 44 may include metals, such as tungsten, titanium, stainless steel, and the like, dielectrics, such as silicon dioxide, silicon nitride, and the like, and semiconductors, such as silicon, germanium, and the like. The object 44 may also include a layer of any of the previously mentioned materials on a substrate, which is not limited to just semiconductor substrates. For example, the substrate may be an aluminum alloy coated with one or more of the previously mentioned materials. The aluminum alloy may include magnesium or manganese that makes the alloy less malleable. If the substrate or object 44 consist of fragile materials, such as silicon, silicon dioxide, and the like, the thickness of the substrate or object may be thicker than a typical semiconductor substrate to improve mechanical support and to help reduce the likelihood of fracturing the object 44 during the modifying of the polishing pad.

Figure 5:
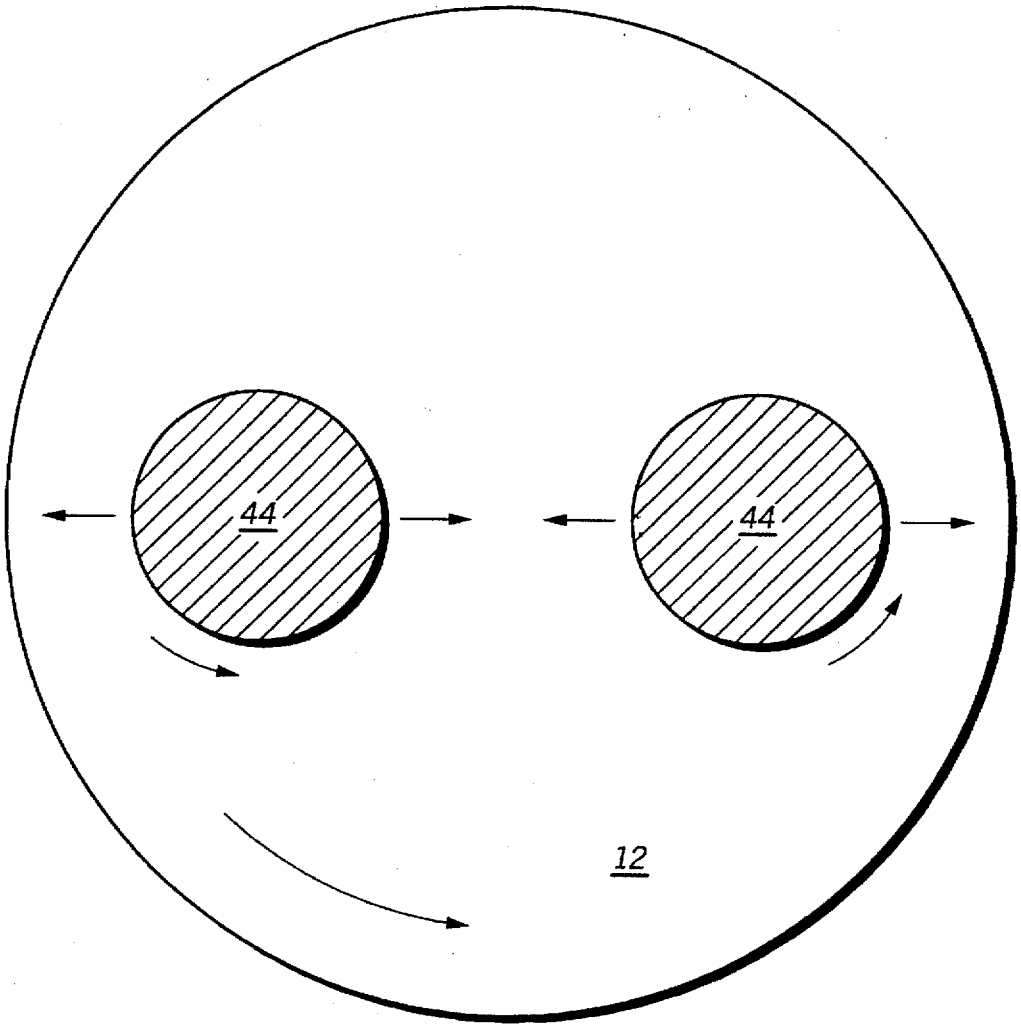

The polishing pad 12 is modified by objects 44 as shown in FIG. 5. The modifying is similar to polishing. Many of the modifying parameters are the same as polishing parameters. Unlike the polishing pressure, the modifying pressure is at least about 10 pounds per square inch (about 69 kilopascals). As used in this specification, modifying pressure is the pressure between the objects 44 and the polishing pad during modifying. Because object 44 has adequate mechanical support, it can withstand the modifying pressure without a significant risk of fracturing.

Figure 6:
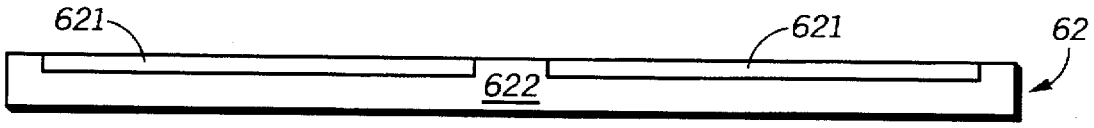
FIG. 6 includes a cross-sectional view of a portion of a modified polishing pad formed in accordance with the present invention.

During modifying, the asperities in the polishing pad 12 are mechanically deformed (as opposed to chemically deformed) to form a modified polishing pad 62 as shown in FIG. 6. As used in this specification, "deformed" means permanently deformed. Regions 621 are at the surface of the polishing pad 62 and have asperities that are mechanically deformed by the modification. The regions 621 generally correspond to the polishing regions of the polishing pad 61. The polishing regions are those portions of the polishing pad to which semiconductor substrates are exposed during polishing. The deformation results in the asperities becoming "flatter" and reduces the root mean square surface roughness. By flatter, it is meant that the asperities have a larger asperity radius and a shorter asperity height. Region 622 is the portion of the polishing pad 62 that is substantially unaffected by the modifying. Region 622 has about the same density as the polishing pad 12 prior to modifying. Therefore, the density of region 622 is substantially the same as before and after modifying. Slurry transport through region 622 should be about the same as slurry transport through polishing pad 12 because its density is not significantly affected by the modifying.

Each region 621 of the modified polishing pad 62 has a plurality of asperities. Each region 621 has an average asperity radius of at least 40 microns, the standard deviation of asperity heights is no more than 30 microns, and the root mean square surface roughness is no more than 30 microns. In one specific embodiment, the modified pad may have an average asperity radius of about 60 microns, the standard deviation of asperity heights is about 25 microns, and the root mean square surface roughness about 35 microns. Obviously, these specific numbers for the parameters do not limit the present invention but merely illustrate one set of parameters. No upper limit on average asperity radius and no lower limits on standard deviation of asperity heights and root mean square surface roughness are known.

Figure 1:
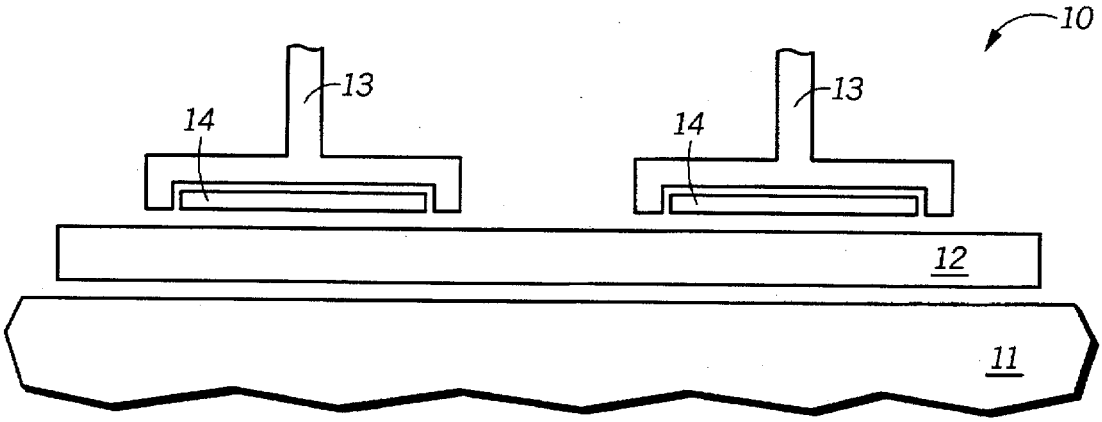
FIGS. 1 and 2 include cross-sectional and top views of a polishing pad and semiconductor substrates during polishing. (Prior art)
Figure 2:
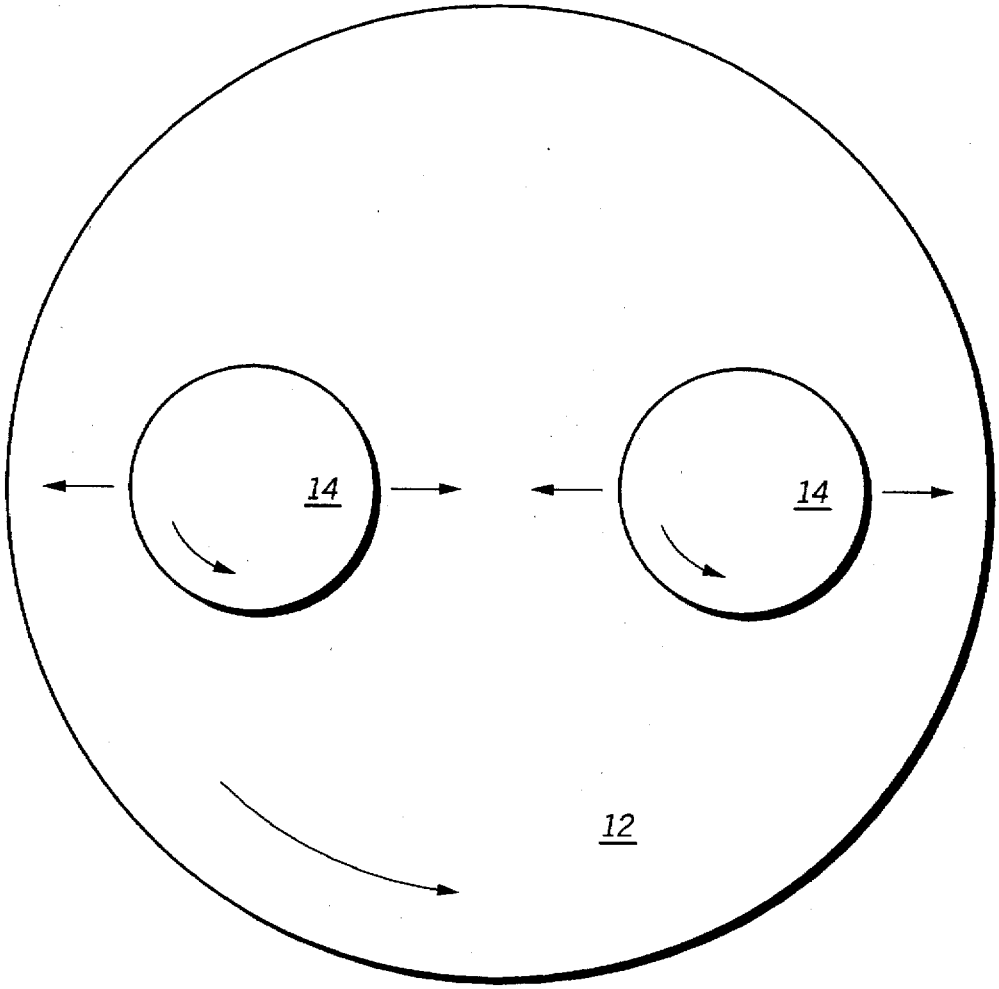
Figure 3:
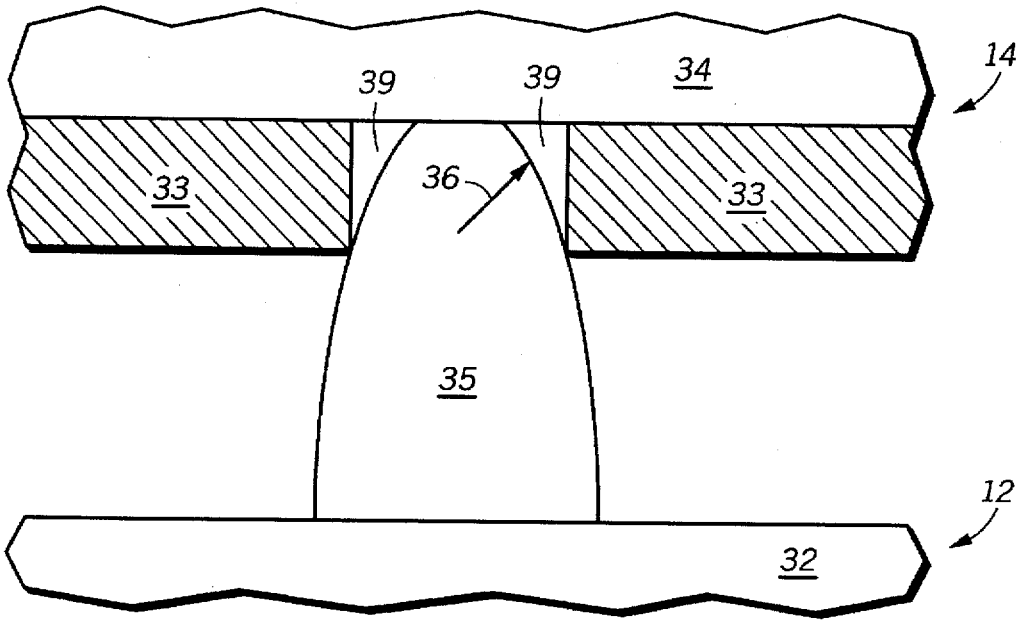
FIG. 3 includes a cross-sectional view of a portion of a polishing pad and portion of a semiconductor substrate illustrating an asperity within an opening in a patterned layer during polishing. (Prior art)
Figure 7:
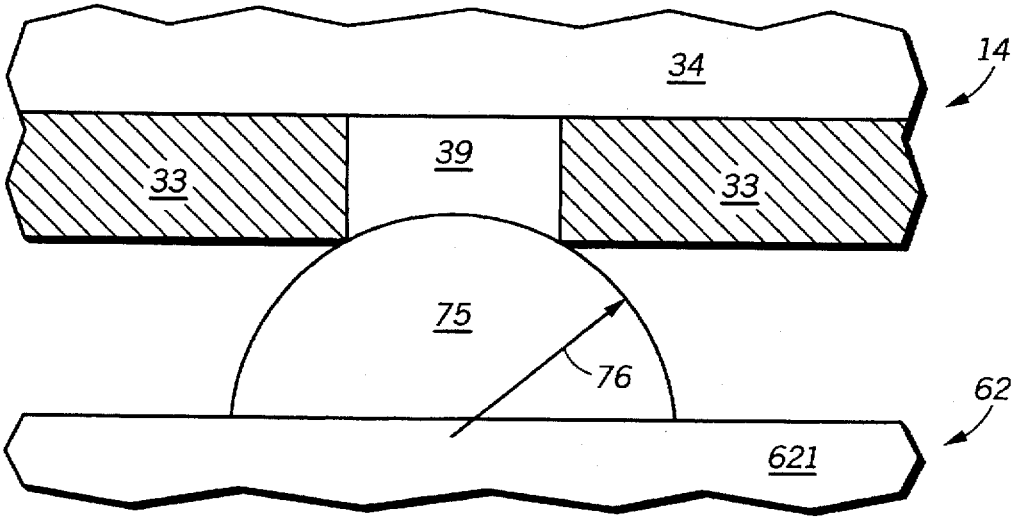
FIG. 7 includes a cross-sectional view of a portion of a modified polishing pad and portion of a semiconductor substrate illustrating an asperity adjacent to an opening in a patterned layer during polishing in accordance with the present invention.

The modified polishing pad 62 is used to polish semiconductor substrates. The polishing equipment and parameters are similar to that shown in and described in conjunction with FIGS. 1 and 2 except that the modified polishing pad 62 replaces the polishing pad 12. During polishing using polishing pad 62, the polishing pressure is generally no higher than about 8 pounds per square inch (about 55 kilopascals). FIG. 7 includes an illustration of a portion of the semiconductor substrate 14 and a portion of the modified polishing pad 62. The semiconductor substrate 14 has the patterned layer 33 with an opening 39 adjacent to region 34. Region 34 may be a semiconductor material or a layer of material adjacent to a semiconductor material that is not shown. The list of possible materials for patterned layer 33 and region 34 are almost limitless.

The modified polishing pad 62 includes region 621 having an asperity 75 that has asperity radius 76 that originates from a center point that is located within region 621. The center point does not need to be located within region 621. The center point may be located within the asperity 75, within region 622, or even beyond the side of the modified polishing pad 62 that is opposite the asperity 75. When comparing FIG. 3 to FIG. 7, the asperity height is shorter for the modified polishing pad, and the asperity radius 76 is larger. The change in the asperity shape is caused by the mechanical deformation of the asperity during the modifying sequence previously mentioned.

As can be seen in FIG. 7, the planarization efficiency of the modified pad should be higher than a fresh pad because asperity 75 is less likely to contact the exposed portion of region 34. There should be no significant mechanical polishing of region 34. Also, modified polishing should cause less corner rounding of the patterned layer 33 adjacent to the opening 39 compared to a fresh pad. Although one asperity is shown in FIG. 7, the surface of the modified polishing pad 62 has a plurality of asperities similar to asperity 75.

Figure 8:
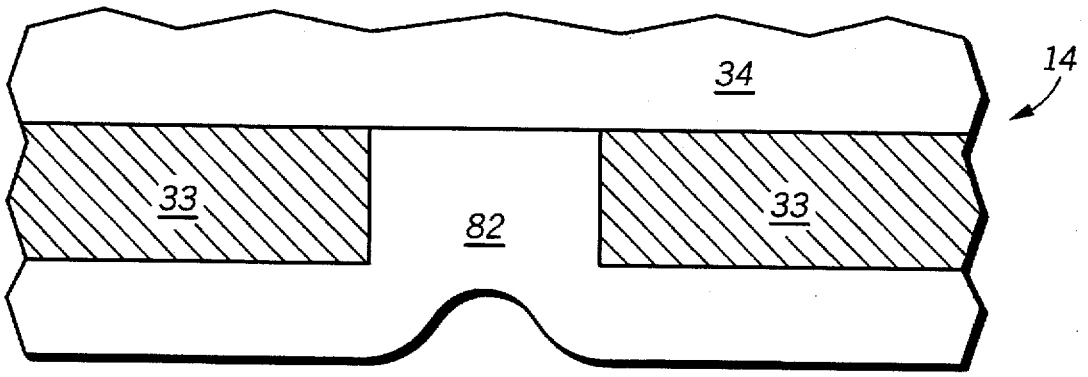
FIG. 8 includes a cross-sectional view of a portion of a semiconductor substrate having a patterned layer with an opening and having another layer lying at the patterned layer and within the opening.
Figure 9:
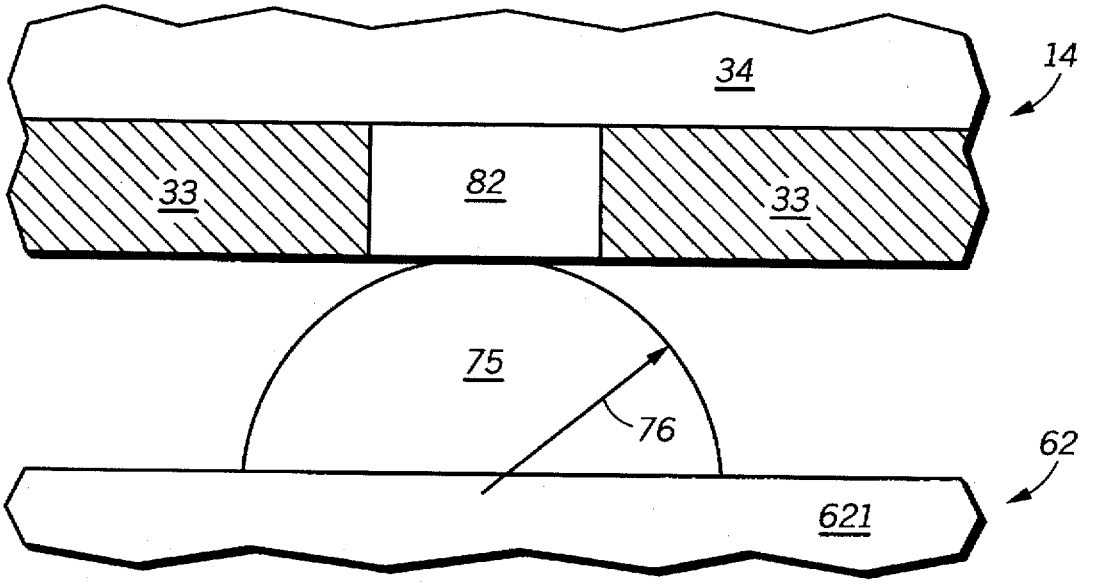
FIG. 9 includes a cross-sectional view of a portion of a modified polishing pad and the semiconductor substrate of FIG. 8 near the end of a polishing step in accordance with the present invention.

In another embodiment, the modified polishing pad 62 may be used in forming contact or via plugs. As shown in FIG. 8, substrate 14 includes region 34 and the patterned layer 33. In this embodiment, region 34 may be conductive, and patterned layer 33 may include an insulating material. Layer 82 is a conductive material that may be the same or a different material compared to region 34. Layer 82 lies at the patterned layer 33 and within the opening of the patterned layer. The substrate 14 is polished using the polishing pad 62 as shown in FIG. 9. The polishing pad 62 removes the portion of layer 82 that lies at the surface of the patterned layer 33 and leaves the portion of layer 82 that lies within the opening. The amount of dishing caused by the modified polishing pad 62 is expected to be less compared to a fresh pad. In yet another embodiment, an insulating material may be used to fill an opening between two conductive members. Referring to FIGS. 8 and 9, region 34 and layer 82 may include insulating materials and layer 33 may be include a conductive material. After polishing the insulating layer 82 fills the opening between the conductive members of layer 33.

The present invention provides many benefits. The pad modifying is relatively simple to do and can be performed using readily available materials. For example, if 200 millimeter diameter wafers are to be polished, the modifying may be performed using a 200 millimeter diameter fused quartz plate that is about 5 millimeters thick. This is just one example and is not intended to be limiting. The modifying parameters are substantially the same as the polishing parameters except that the modifying pressure should be high enough to mechanically deform the asperities. The modifying pressure is typically at least about 10 pounds per square inch (about 69 kilopascals). As previously stated, the modified polishing pad should be less likely to polish materials that are exposed within an opening of a patterned layer and to substantially change the shape of the openings. The modification also decreases the root mean square surface roughness of the polishing pad. The decreased root mean square surface roughness should help to reduce dishing effects compared to a fresh pad.

The present invention is not limited by the embodiments or materials listed herein. The present invention may be used on a polisher capable of polishing any number of semiconductor substrates during the same polishing step. In addition, the modification of the polishing pad does not need to be performed on a polisher. The polishing pad may be modified using any piece of equipment that has or can be fitted with a smooth, hard surface.

In the foregoing specification, the invention has been described with reference to specific embodiments thereof. However, it will be evident that various modifications and changes can be made thereto without departing from the broader spirit or scope of the invention as set forth in the appended claims. Accordingly, the specification and drawings are to be regarded in an illustrative rather than a restrictive sense.

What is claimed is:

1. A process for forming and polishing a layer over a semiconductor substrate comprising the steps of:

forming a first layer over a semiconductor substrate;

placing the semiconductor substrate and the first layer into a polisher having a polishing pad including a first region and a second region, wherein:

each of the first and second regions includes a plurality of asperities having an average asperity radius, a standard deviation of asperity heights, and a root mean square surface roughness;

the first region has a characteristic selected from a group consisting of:

the average asperity radius is at least 40 microns;

the standard deviation of asperity heights is no more than 30 microns; and the root mean square surface roughness that is no more than 30 microns; and the second region does not have:

the average asperity radius that is at least 40 microns;

the standard deviation of asperity heights that is no more than 30 microns; and a root mean square surface roughness that is no more than 30 microns; and polishing the first layer wherein this step is performed such that the first layer overlies the first region but does not overlie the second region.

2. The process of claim 1, wherein:

the average asperity radius within the first region is at least 40 microns;

the standard deviation of asperity heights within the first region is no more than 30 microns; and the root mean square surface roughness within the first region is no more than 30 microns.

3. The process of claim 1, wherein the step of polishing is performed at a polishing pressure no more than about 8 pounds per square inch.

4. The process of claim 1, further comprising a step of patterning the first layer prior to the step of polishing.

5. The process of claim 4 wherein:

the first layer has an opening;

an exposed region of the semiconductor substrate lies at the opening; and the step of polishing is performed without significantly polishing the exposed region.

6. The process of claim 4, wherein:

the first layer has an opening; and the step of polishing is performed without substantially rounding corners of the first layer that are adjacent to the opening.

7. The process of claim 4, further comprising a step of forming a patterned second layer having an opening prior to the step of forming the first layer, wherein:

the step of forming the first layer is performed such that the first layer lies within the opening in the patterned second layer and overlies the patterned second layer; and the step of polishing removes the portion of the first layer that lies outside the opening.

8. The process of claim 7, wherein the step of polishing results in less dishing compared to polishing with a fresh pad.

9. A process for forming and polishing a layer over a semiconductor substrate comprising the steps of:

placing an object adjacent to a polishing pad, wherein:

the polishing pad includes a first region and a second region;

prior to this step, each of the first and second regions does not have:

an average asperity radius that is at least 40 microns;

a standard deviation of asperity heights that is no more than 30 microns; and a root mean square surface roughness that is no more than 30 microns;

pressing the object against the first region but not the second region until the first region has a characteristic selected from a group consisting of:

the average asperity radius is at least 40 microns;

the standard deviation of asperity heights is no more than 30 microns; and the root mean square surface roughness is no more than 30 microns;

forming a patterned first layer over a semiconductor substrate, wherein the patterned first layer has an opening;

forming a second layer over the patterned first layer and within the opening; and polishing the second layer to remove the portion of the second layer that lies outside of the opening, wherein this step is performed such that the second layer overlies the first region of the polishing pad but does not overlie the second region of the polishing pad.

10. The process of claim 9, wherein the step of pressing continues until:

the average asperity radius is at least 40 microns;

the standard deviation of asperity heights is no more than 30 microns; and the root mean square surface roughness is no more than 30 microns.

11. The process of claim 9, wherein:

the step of pressing continues until only the first region of the polishing pad becomes deformed; and the average asperity radius, the standard deviation of asperity heights, and the root mean square surface roughness of the second region are substantially the same before and after the step of pressing.

12. The process of claim 9, wherein the step of the pressing is performed at a pressure of at least about 10 pounds per square inch, and the step of polishing is performed at a pressure no higher than 8 pounds per square inch.

13. The process of claim 9, wherein the object is thicker than the semiconductor substrate.

14. The process of claim 9 wherein the object includes a metal.

15. A process for polishing a semiconductor substrate comprising the steps of:

placing an object adjacent to a polishing pad including a first region and a second region;

pressing the object against the first region but not the second region, wherein:

the pressing deforms the first region but not the second region; and the pressing is performed at a pressure of at least about 10 pounds per square inch;

forming a patterned first layer over a semiconductor substrate, wherein the patterned first layer has an opening;

forming a second layer over the patterned first layer and within the opening; and polishing the second layer to remove the portion of the second layer that lies outside of the opening, wherein:

this step is performed such that the second layer overlies the first region of the polishing pad but does not overlie the second region of the polishing pad; and this step is performed at a pressure no higher than about 8 pounds per square inch.

16. The process of claim 15, wherein:

the first region has a plurality of asperities having an average asperity radius and a standard deviation of asperity heights;

prior to the step of pressing, each of the first and second regions does not have:

an average asperity radius that is at least 40 microns;

a standard deviation of asperity heights that is no more than 30 microns; and a root mean square surface roughness that is no more than 30 microns; and the step of pressing continues until the first region has a characteristic selected from a group consisting of:

the average asperity radius is at least 40 microns;

the standard deviation of asperity heights is no more than 30 microns; and the root mean square surface roughness is no more than 30 microns.

17. The process of claim 15, wherein the object is thicker than the semiconductor substrate.

18. The process of claim 15, wherein the object includes a metal.

* * * * *